United States Patent [19]

Woodruff et al.

[11] 4,026,188

[45] May 31, 1977

[54] MODULAR BUOY SYSTEM

[75] Inventors: Thomas E. Woodruff, Nashua; Roger I. Saunders, Hollis, both of N.H.

[73] Assignee: Sanders Associates, Inc., Nashua, N.H.

[22] Filed: Dec. 24, 1975

[21] Appl. No.: 644,791

[52] U.S. Cl. ..... 89/1.5 R; 102/34.5; 102/37.7

[51] Int. Cl.[2] ..... F41F 5/02

[58] Field of Search ..... 89/1.5 R, 1.5 E; 102/7.2, 37.6, 37.7, 21.6, 34.5, 35.2, 35.4 7, 35.6, 37.1; 175/4.55

[56] References Cited

UNITED STATES PATENTS

| | | | |
|---|---|---|---|
| 2,913,198 | 11/1959 | Bonbrake | 89/1.5 R X |
| 3,010,396 | 11/1961 | Coleman | 175/4.55 |
| 3,095,814 | 7/1963 | Jansen et al. | 102/37.6 X |
| 3,116,689 | 1/1964 | Sumner | 175/4.55 X |
| 3,142,959 | 8/1964 | Klein | 102/34.5 X |
| 3,246,707 | 4/1966 | Bell | 175/4.55 X |
| 3,266,372 | 8/1966 | Mack et al. | 89/1.5 R |
| 3,368,480 | 2/1968 | Payne et al. | 102/7 |
| 3,451,306 | 6/1969 | Lagerstrom et al. | 89/1.5 R X |
| 3,768,408 | 10/1973 | Hallmark | 102/21.6 |
| 3,787,012 | 1/1974 | Jakubowski | 89/1.5 R X |

*Primary Examiner*—David H. Brown
*Attorney, Agent, or Firm*—Louis Etlinger; William L. Hunter

[57] ABSTRACT

A modular buoy system in which a number of similar sonobuoys are housed in a common container. Associated with each sonobuoy is a launching mechanism. A circuit is provided for actuating these launching mechanisms separately so that the sonobuoys may be ejected from the container one at a time.

18 Claims, 9 Drawing Figures

MODULAR BUOY SYSTEM

FIELD OF THE INVENTION

This invention relates generally to sonobuoy systems and particularly to such systems comprising several sonobuoys which can be launched separately.

BACKGROUND

In the past, one common way of handling sonobuoys has been to make each of a size to fit in a standard container which serves as both a storage container and as a launch tube. The container was provided with a launching mechanism, for example a cartridge actuated device, which, upon actuation, ejected the sonobuoy into the water. There are a number of "standard" sonobuoy sizes. By way of example, one widely used size is known as an "A" size and its container is a cylindrical tube approximatly 3 feet long and 5 inches in diameter.

Changes in the missions of sonobuoys and advances in the sonobuoy art have made it desirable to reduce the size of sonobuoys. Such reduction, if done indiscriminately, could result in a proliferation of new containers, each of a size and configuration to accomodate a new smaller sonobuoy, many of which would be incompatable with each other and with existing storage and launching equipment both aground and aloft. On the other hand, if one were simply to place two or more small sonobuoys in one of the existing standard containers, they might well be launched simultaneously which is usually not a desirable mode of operation.

PURPOSE OF THE INVENTION

It is a general purpose of the present invention to provide an improved sonobuoy system in which several sonobuoys are stored in a single standard container from which they may be ejected separately.

SUMMARY OF THE INVENTION

Briefly stated, a sonobuoy system incorporating the present invention comprises a plurality of sonobuoys housed in a single container along with a like plurality of launch mechanisms. Provision is made for actuating the launch mechanisms individually so that the sonobuoys may be launched separately instead of simultaneously. More particularly, one preferred embodiment of the invention comprises a container, a plurality of sonobuoys in said container, a like plurality of launch mechanisms, one for each sonobuoy, each for ejecting its associated sonobuoy from said container in response to a signal, means for receiving signals successively, and means for directing successive signals so received to said launch mechanisms sequentially.

DESCRIPTION OF PREFERRED EMBODIMENTS

For a clearer understanding of the invention reference may be made to the following detailed description in the accompanying drawing in which.

Figure 1:
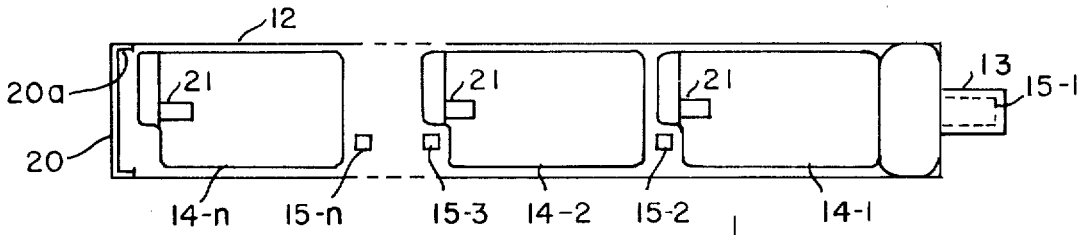
FIG. 1 is a schematic diagram showing plurality of sonobuoys in a single container.

Referring first to FIG. 1 there is shown a container 12. the container may be any of various shapes but at present it is preferred that it be a generally cylindrical tube. The particular container illustrated is suitable for housing a single sonobuoy occupying substantially the entire interior space and, indeed, was originally designed for this purpose. The container 12 includes a removable housing 13 installed on one end and adapted to enclose a launch mechanism which, in the case of a single sonobuoy, is preferably an electrically actuated explosive cartridge, which, upon actuation, generates a quantity of gas and ejects the sonobuoy from the container. However, in accordance with the present invention, a plurality of generally cylindrical sonobuoys **14-1, 14-2 . . . 14-*n* are placed in the container 12. Associated with the sonobuoys 14-1 . . . 14-*n* are corresponding launch mechanisms 15-1, 15-2 . . . 15-*n* respectively, the mechanism 15-1 occupying the housing 13. These launch mechanisms may be any of several kinds, such as the cartridge variety noted above, but it is preferred at present that each comprise a reservoir of compressed gas along with a release mechanism, as will be fully described subsequently. The other end of the container 12, the end at the left as viewed in FIG. 1, is closed by cap 20, preferably made of a synthetic resin or a similar material, and formed with a flexible flange 20*a* fitting the interior surface of the container 12.**

Figure 3:
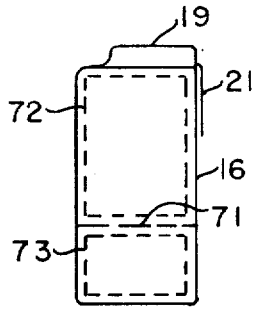
FIG. 3 is an outline drawing of a single sonobuoy before deployment.
Figure 2:
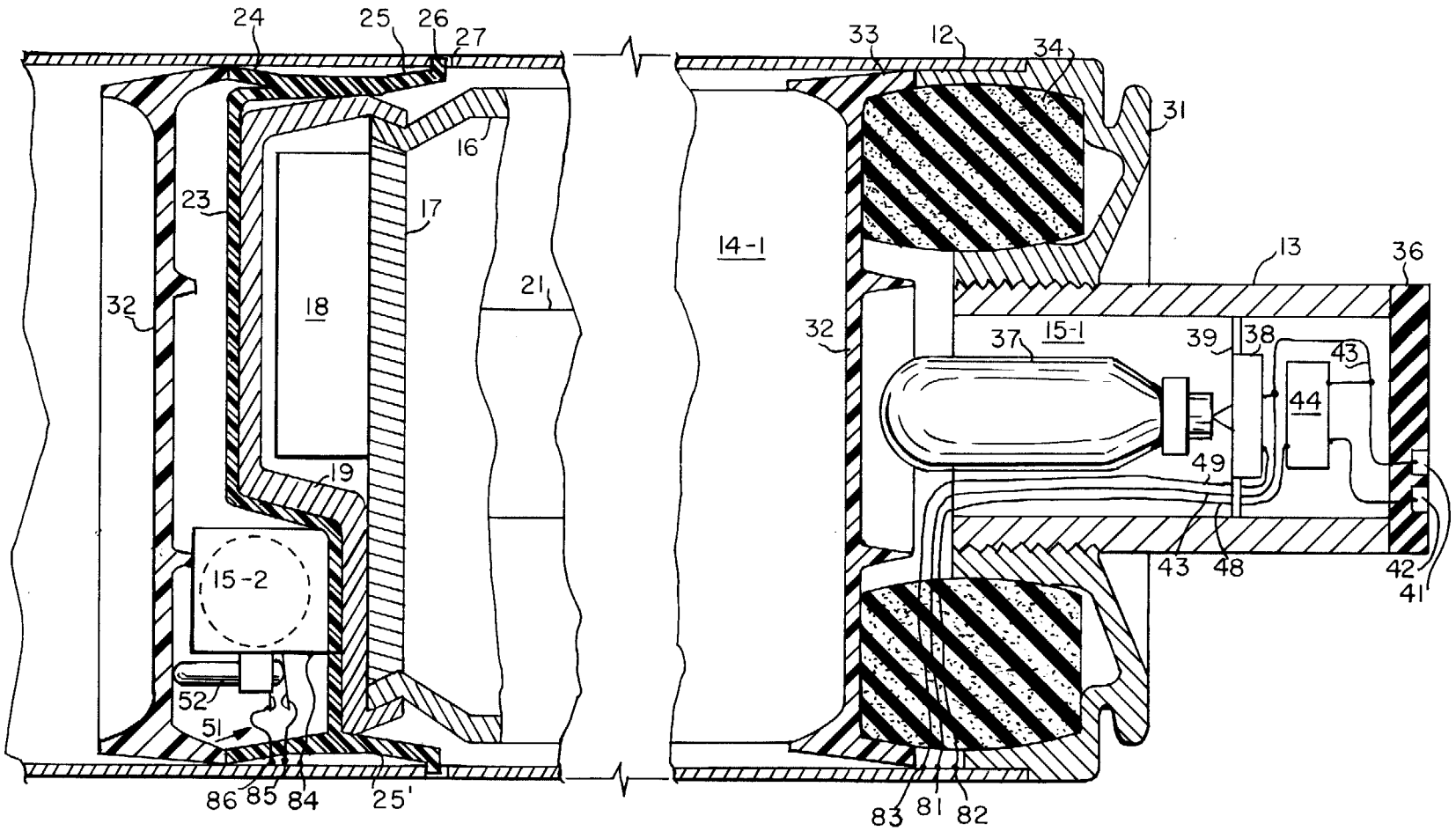
FIG. 2 is a schematic diagram, partly in elevation and partly in section, showing in more detail how the sonobuoys of FIG. 1 are installed.

FIG. 2 shows to an enlarged scale the mounting arrangement for one of the sonobuoys, namely the sonobuoy 14-1. Since all these sonobuoys are identical the distinguishing suffix of the reference characters will be omitted except when necessary to distinguish between sonobuoys. As best shown in FIG. 2, each sonobuoy includes a generally cylindrical skin 16, the forward end of which (the end to the left as viewed in FIG. 2), is sealed closed by means of a lid 17 which, after manufacture, is essentially integral with the skin 16. A package 18 is mounted on the outside of the lid 17. This package includes an element (not shown) such as a parachute or the like to slow the descent of the buoy when it is launched and also contains a rolled up or folded antenna (not shown in FIG. 2). The package 18 occupies only a portion of the surface of the lid 17. A cover 19, fastened to the lid, extends over the package 18 and over the portion of the lid not occupied by the package 18. As shown, the cover 19 hooks over the lid 17 and is made of a material sufficiently flexible so that it can be readily removed. As best shown in FIG. 3, a cover pull off flap 21 extends from the cover 19 along the outside surface of the buoy so that it may be caught by the wind during the descent of the buoy so as to pull off the cover 19, thereby rendering the parachute or other descent slowing mechanism and the antenna operative.

A generally cylindrical forward bulkhead or piston 23 preferably made of a resilient, synthetic resin or plastic, is contoured to cradle the forward end of sonobuoy 14, that is, it follows generally the outer contour of the cover 19. It is formed with a generally cylindrical flange 24 which extends a short distance in the forward direction, that is, in the axial direction away from the buoy it cradles, and engages the inner cylindrical surface of the container 12 forming a substantially gas tight seal. This seal facilitates launching, as will be described subsequently. The forward bulkhead 23 is also formed with a plurality (for example four) of aft extending fingers, two of which, fingers 25 and 25', are shown in FIG. 2. These fingers extend adjacent to the interior surface of the container 12 and each is formed with a radially extending tab 26 which extends into a slot or aperture 27 formed in the container 12 so as to hold the buoy in place prior to its launching. Each of the tabs 26 is made frangible so that the bulkhead 23 may be ejected along with the buoy 14-1.

The container 12 includes a generally cup shaped cap 31 closing one end, the right end as viewed in FIG. 2, which cap is permanently fastened to the rim of the container 12. The cap 31 is formed with an axial aperture provided with internal threads to receive the previously mentioned housing 13. The right, or aft, end of the buoy 14-1 (as well as the right end of each of the other buoys) is cradled by an aft bulkhead or piston 32 preferably made of a synthetic resin or a similar material. The bulkhead 32 is formed with a flange 33 extending axially aft, that is, away from the buoy it cradles, engages the interior surface of the container 12. A ring 34 of resilient material such as sponge rubber is positioned between the piston 32 and the cap 31 to cushion the buoy 14-1.

The housing 13 is generally tubular and closed by an end cap 36. Within the housing 13 is the previously mentioned launch mechanism 15-1 which comprises a reservoir 37 of a gas, such as carbon dioxide, under pressure. A small explosive squib 38 is mounted by means of a bracket 39 on the housing 13 and is arranged to pierce the container 37 when actuated by a suitable electrical signal.

A pair of electrical terminals 41 and 42 in the cap 36 are adapted to receive external signals successively for actuating each of the launching mechanisms. An electric circuit is provided which interconnects the terminals 41 and 42 with the launching mechanisms and directs successive signals to the launching mechanisms sequentially. More particularly, a conductor 43 extends from the terminal 41 to the squib 38 and to one terminal of a thermal switch 44. Conductor 43 also extends, through the interior of the housing 13, between the bulkhead 32 and the cap 31 and through the ring 34 to a conductor 45. The conductor 45 is one of three conductors, 45, 46, and 47, which extend axially along the surface of the container 12 as will be more fully explained. The terminal 42 is connected to the input terminal of the switch 44, the output terminal of which is connected through conductor 48 along a path generally parallel to that of the conductor 43 to the conductor 46. A conductor 49 extends from the squib 38 along a similar path to the conductor 47.

Figure 4:
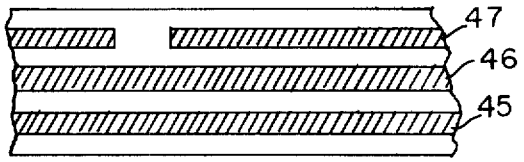
FIG. 4 is a schematic diagram of a flexible printed circuit.

The conductors 45, 46 and 47 may conveniently be in a form commonly known as a flexible printed circuit. Such a circuit is shown schematically in FIG. 4 as comprising the three conductors 45, 46 and 47. The details of such a circuit are not a part of the present invention and it is sufficient to note that the conductors may be encapsulated between two thin layers of an insulating, thermoplastic material, the entire assembly being only a few thousandths of an inch thick and being sufficiently flexible so that the circuit may be readily fastened to the container 12. The circuit may be run along the exterior of the container 12 and electrical connections made through apertures at appropriate places but it is preferred at present that the circuit be fastened to the interior surface. The insulating material is removed in those areas in which connections are to be made. It is noted that the conductor 47 is discontinuous for reasons which will be fully explained later.

Figure 5:
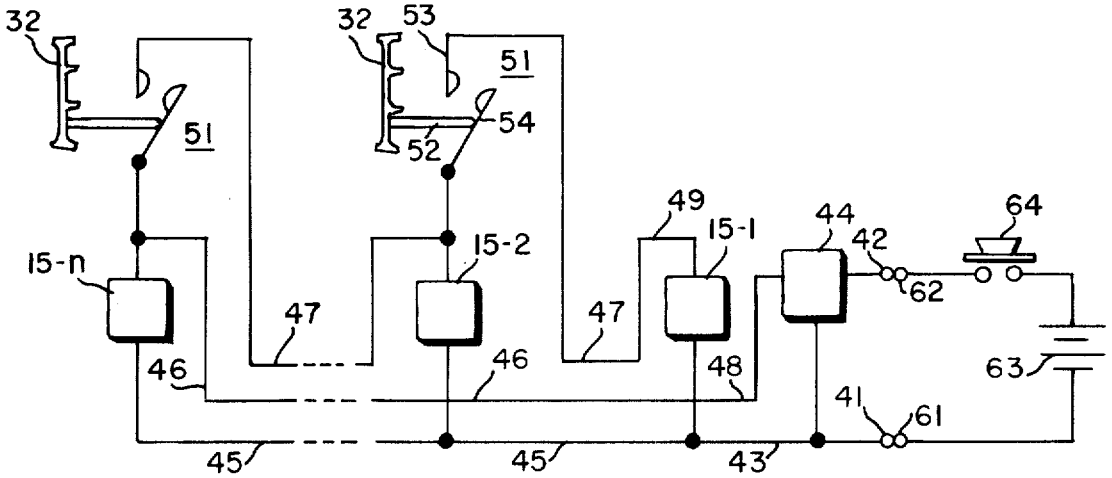
FIG. 5 is a circuit diagram of the electrical connections.

Returning now to FIG. 2, there is shown a launch mechanism 15-2 which is fastened to the forward bulkhead 23 and which is similar to the launch mechanism 15-1 previously described. There is also provided a switch 51 actuated by a pin 52 which is engaged by the aft bulkhead 32 of the sonobuoy 14-2. As best shown in FIG. 5, the switch 51 comprises a fixed contact 53 and a moveable contact 54 made of a resilient material so that it is inherently urged toward contact with the fixed contact 53. However, the contact 54 is held out of engagement with the contact 53 by the pin 52 as long as the sonobuoy 14-2 is in place in the container. When the sonobuoy 14-2 is ejected, along with the bulkhead 32, the inherently springy contact 54 pushes the pin 52 out of the way and engages the fixed contact 53.

Continuing with FIG. 5, there is shown schematically the circuit by which these sonouoys are launched one at a time. The previously mentioned terminals, or contacts, 41 and 42 engage contacts 61 and 62 respectively which lead to an external command circuit, shown schematically as comprising a battery 63 and a normally open switch 64 in series between the contacts 61 and 62. The switch 64 is shown schematically as a manually operated push button switch but it will be understood that it may be any sort of switch, mechanical, solid state or otherwise, operated manually or automatically.

As previously mentioned, the terminal 41 is connected to the previously mentioned thermal switch 44 and is also connected through the conductor 43 to the common conductor 45. The latter is connected to one terminal of each of the launch mechanisms 15-1, 15-2 . . . 15-n. The terminal 42 is connected to the previously mentioned thermal switch 44 the output of which is connected through the conductor 48 to the conductor 46. The switch 44 is one which, upon application of an electric signal thereto, passes the signal to its output for a predetermined time and then opens contacts which remain open until the signal is removed whereupon contacts are again closed. Such switches are well known in the art and one suitable model is available commercially from the Amperite Company, Inc. of Union City, N.J., as model No. 26-C2.

The conductor 46 is connected to the remaining terminal of the launch mechanism 15-*n*, which is associated with the buoy 14-*n* which is the first buoy to be launched. The conductor 46 is also connected to one terminal of the associated switch 51 the other terminal of which is connected through one section of the conductor 47 to the next adjacent launch mechanism. The dotted lines of conductors 45, 46 and 47 indicate where launch mechanisms associated with succeeding sonobuoys may be connected. If there are no sonobuoys between buoy 14-2 and 14-*n*, that is, if there are but three sonobuoys altogether, then this latter mentioned section of conductor 47 would be connected directly to launch mechanisms 15-2 and to one terminal of the associated switch 51 the other terminal of which would be connected through another section of conductor 47 to the launch mechanism 15-1.

The system is assembled by first inserting and fastening the printed circuit, comprising conductors 45, 46 and 47, to the interior of the container, with suitable breaks in the conductor 47 and with the upper layer of insulation removed above each conductor adjacent to the location of each launch mechanism. Next, as best shown in FIG. 2, the conductors 43, 48 and 49 are installed through the sponge rubber ring 34 and preferably are provided with spring contacts, shown schematically by the dots 81, 82 and 83, for engaging the conductors 45, 46 and 47. The ring 34 with the conductors through it is then installed as shown. Next the housing 13 with the launch mechanism 15-1 inside, is screwed on, the electrical connections made as shown, and the cap 36 installed.

Each sonobuoy is cradled between an aft bulkhead 32 and a forward bulkhead 23 and a launch mechanism 15-2, 15-3, etc. is installed on each forward bulkhead, as shown, except the bulkhead associated with the last buoy, 14-*n*. Electrical connections are made between each launch mechanism and its associated switch 51 as shown in FIGS. 2 and 5. Connections to the conductors 45, 46 and 47 are made by passing three wires through the forward bulkhead 23 and equipping them with spring contacts, shown schematically in FIG. 2 at 84, 85 and 86. The sonobuoys are then inserted one at a time, with the tabs 26 and the contacts 84, 85 and 86 of each sliding along the interior surface of the container 12 until the appropriate recesses 27 are reached, whereupon the tabs spring outward into the recesses and hold the buoys in position and the contacts engage the conductors 45, 46 and 47. Preferably the tabs 26 and the recesses 27 for the various buoys are angularly staggered with respect to each other and to the printed circuit conductors 45, 46 and 47 so that each buoy may be readily inserted and held in its proper position. Finally, the cap 20 is installed.

OPERATION

When it is desired to launch a buoy, an electrical signal is generated by closure of the switch 64 (FIG. 5). This signal passes through the contacts 62 and 42, the thermal switch 44, the conductor 48 and the conductor 46 to the upper terminal of the launch mechanism 15-*n*, which is associatedwith the buoy 14-*n* at the end of the container. The other terminal 41 is connected to the common conductor 45 and accordingly this signal energizes the squib 38 in launch mechanism 15-*n* thereby puncturing the associated reservoir 37 and allowing the gas to escape and build up a pressure between the bulkheads 23 and 32. The flanges 24 and 33 are pressed against the interior of the container 12 and, when the pressure has risen sufficiently the tabs 26 will shear off and the buoy 14-*n* and its bulkheads 23 and 32 will be ejected from the container 12, pushing the cap 20 ahead of them. The pin 52 is no longer held by the bulkhead 32 and accordingly the moveable contact 54 pushes the pin aside and engages the stationary contact 53. Such closure enables the circuit for the next launch mechanism, that is, it closes a circuit from the conductor 46, through the switch 51 and a section of the conductor 47 to the next launch mechanism. However, this next launch mechanism is not actuated because the thermal switch 44 maintains its contacts closed only long enough for the initial squib to be actuated so that, by the time the switch 51 is closed, the thermal switch 44 has opened so that even if the switch 64 remains closed, no further buoys will be launched. In order to launch another buoy it is necessary that the signal be removed, that is, that the switch 64 be opened so as to allow the switch 44 to close and then a new signal must be generated by reclosing the switch 64. Upon receipt of the next signal, the next succeeding launch mechanism will be actuated since its circuit had been enabled by the closure of the preceding switch 51. The preceding launch mechanism and its associated switch has no further purpose to serve and will be ejected by the next buoy. In this manner, successive signals applied to the terminals 41 and 42 are directed to the launch mechanisms sequentially so that successive signals launch successive buoys.

As previously mentioned, each buoy is cradled by a forward bulkhead 23 and aft bulkhead 32. These bulkheads serve to hold the buoys in position in the container 12 during storage and transportation and act as pistons during the launching operation. However, after each buoy is launched its associated bulkheads (which are ejected from the container with the buoy) have no further purpose to serve. Since they are not fastened to anything, they fall away from the buoy.

As shown schematically in FIG. 3, each of the buoys is divided into two sections by a permanent fluid tight interior bulkhead 71. The upper section serves as a buoyancy chamber and contains an electronics package 72 including the necessary batteries, amplifiers, and the transmitter. The lower section contains a sensing package 73, typically containing one or more acoustic devices, reels of wire, payout devices, and a bottom release mechanism, all as is well known in the sonobuoy art. As the buoy descends, air engages the flap 21 thereby pulling off the cover 19. The previously mentioned descent retardation mechanism (not shown) operates and the antenna is erected.

Figure 6:
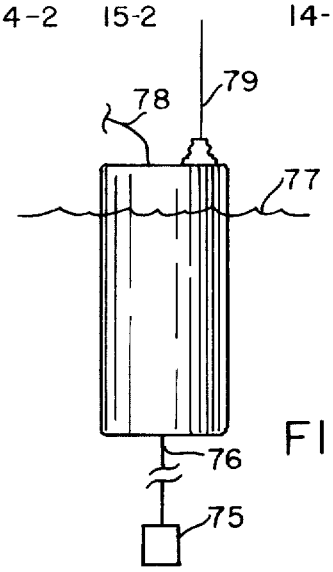
FIG. 6 is an outline drawing of a single sonobuoy after its deployment in the water.

The buoy descends and eventually strikes the water whereupon the bottom release mechanism (not shown) operates allowing the sensor 75 to descend, supported by the cable 76. As shown in FIG. 6, the buoy becomes stabilized, floating with a portion above the waterline 77. The descent retardation mechanism may be jettisoned or in some cases may remain attached by its cord 78. The antenna 79 is erect and in operating position.

Figure 7:
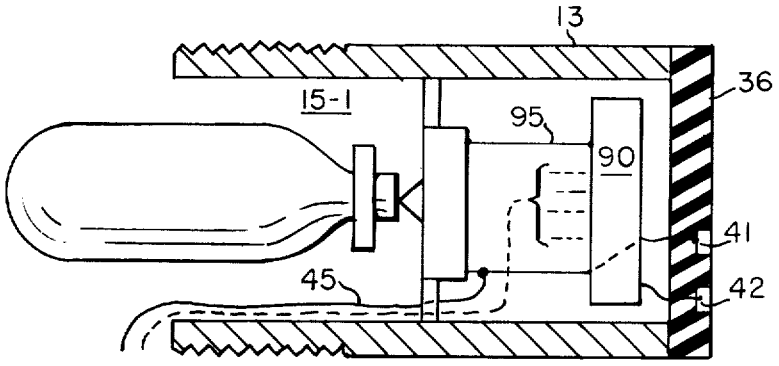
FIG. 7 is a fragmentary schematic view showing a modification of the arrangement for directing signals to the launch mechanisms sequentially.
Figure 8:
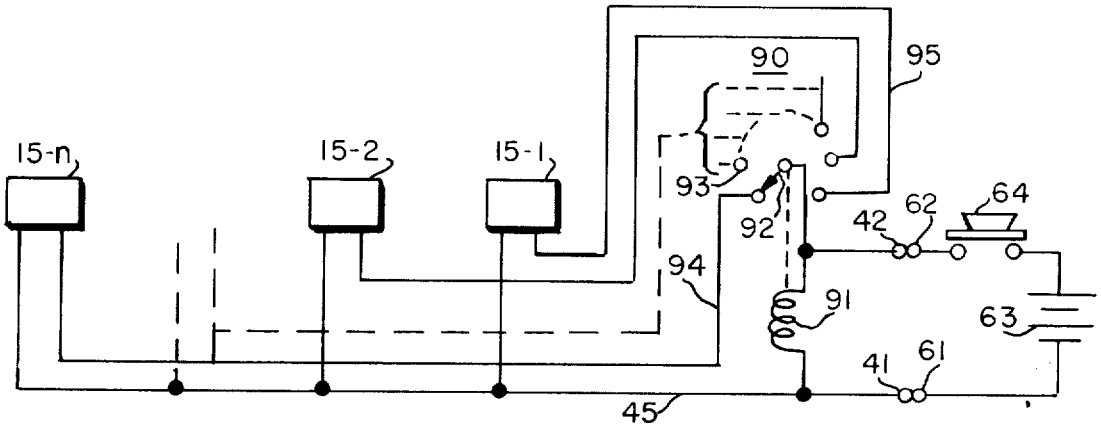
FIG. 8 is an electric diagram of the arrangement of FIG. 7.

Referring now to FIGS. 7 and 8, there is shown an alternate electriccircuit for directing successive signals to the launch mechanisms sequentially. The terminals 41 and 42 are connected to a stepping switch 90. Stepping switches are well known in the art and operate to connect successively received signals to successive output conductors. As shown schematically in FIG. 8, the switch 90 includes an operating winding 91 connected across the terminals 41, 42 and a moveable contact 92, connected to the terminal 42, which cooperates with a plurality of stationary contacts 93. The terminal 41 is connected to the common conductor 45. There are at least as many stationary contacts 93 as there are launch mechanisms and each contact 93 is connected to one launch mechanism. Initially the moveable contact 92 is in engagement with that one of the contacts 93 which is connected through a conductor 94 to the launch mechanism 15-*n*. The last of the contacts 93 is connected by a conductor 95 to the launch mechanism 15-1. Intermediate contacts 93 are connected to intermediate launch mechanisms. All of the launch mechanisms are connected to the common conductor 45. Connections from the switch 90 to the launch mechanisms 15 are made preferably through a printed circuit (not shown) having a common conductor plus one conductor for each launch mechanism other than the mechanism 15-1 or may have two conductors for each mechanism other than the mechanism 15-1. The moveable contact is assumed to rotate clockwise, as viewed in FIG. 8, and moves from one contact 93 to the next each time the winding 91 is de-energized.

The first signal received on terminals 41 and 42 will be passed through the common conductor 45 and through the moveable contact 92, the first contact 93 and the conductor 94 to the launch mechanism **15-*n*, thereby launching the sonobuoy 14-*n*. At the same time the winding 91 will be energized but the moveable contact will not move at this time. When the first signal has ended, the winding 91 will be de-energized whereupon the contact 92 will be stepped to the next contact 93**. Upon receipt of the next signal, the next sonobuoy will be launched. Successive signals launch successive sonouoys until all have been launched.

Figure 9:
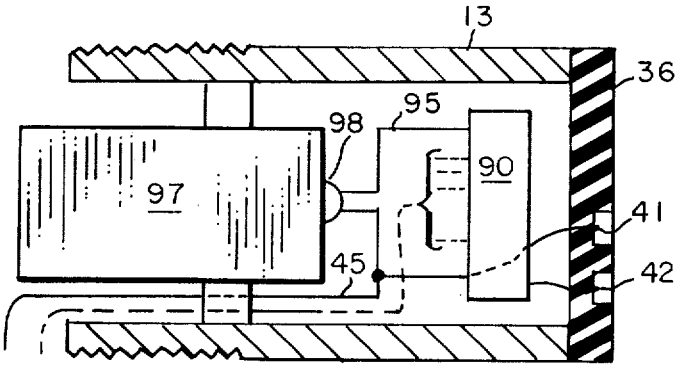
FIG. 9 is a fragmentary view showing an alternate form of launch mechanism.

Referring now to FIG. 9 there is shown an alternate form of launch mechanism. A cartridge 97 contains combustible material which, when ignited, burns thereby generating a large quantity of a gas. The resulting pressure launches the sonobuoy. The cartridge is fired by an electrically actuated igniter 98 which, in FIG. 9, is shown associated with the stepping switch 90. However, it is apparent that the igniter 98 could equally as well be actuated by the sequencing arrangement shown in FIGS. 2 and 5.

From the foregoing it can be seen that applicants have provided a novel sonobuoy system. The use of the modular design provides unusual versatility. Various sized buoys can be designed with the same diameter but in various lengths so that different numbers can be stored in and launched from identical containers. More demanding missions may dictate the use of but one or two sonobuoys per container while simpler missions may allow the use of three, four or more smaller buoys. Additionally, each buoy itself is versatile in that the same basic electronics package can be used with various arrangements of sensors in the same sized buoy. Also, in many cases, the upper half of the buoy, comprising the electronics package and buoyancy chamber, can be identical for different sizes of buoys.

Although a number of embodiments of the invention have been described in considerable detail for illustrative purposes, many modifications will occur to those skilled in the art. It is therefore desired that the protection afforded by Letters Patent be limited only by the true scope of the appended claims.

What is claimed is:

1. A sonobuoy system, comprising, a container including forward and aft ends, a plurality of sonobuoys in said container, a like plurality of launch mechanisms, one for each sonobuoy, each for ejecting its associated sonobuoy through said forward end of said container in response to an electric signal, terminals adjacent said aft end for receiving a plurality of substantially identical electric signals successively, and means, including an electric circuit positioned within said container and interconnecting said terminals and said launch mechanisms, for directing successive signals so received to said launch mechanisms sequentially in a predetermined order.

2. A sonobuoy system in accordance with claim 1 in which each of said launch mechanisms includes a reservoir of gas under pressure and means responsive to a signal for releasing said gas.

3. A sonobuoy system in accordance with claim 2 in which said means for releasing includes an electrically actuated squib.

4. A sonobuoy system in accordance with claim 1 in which each of said launch mechanisms includes a cartridge containing a combustible material for generating gas when ignited.

5. A sonobuoy system in accordance with claim 4 including means responsive to a signal for igniting the material in said cartridge.

6. A sonobuoy system in accordance with claim 1 in which each of said sonobuoys includes an interior fluid tight bulkhead dividing said sonobuoy into first and second sections and which includes an electronics package in said first section and a sensor package in said second section.

7. A sonobuoy system in accordance with claim 6 in which said means for directing signal includes an electric circuit connected to said terminals and to that launch mechanism associated with that sonobuoy nearest said forward end of said container and also includes means responsive to the ejection of each sonobuoy from said container for establishing an electrical circuit enabling the launch mechanism associated with the next succeeding sonobuoy.

8. A sonobuoy system in accordance with claim 7 in which said circuit enabling the launch mechanisms includes a plurality of switches, one associated with each sonobuoy except that sonobuoy adjacent the aft end of said container, each of said switches being held open by its associated sonobuoy but closed in response to ejection of that sonobuoy.

9. A sonobuoy system in accordance with claim 6 in which said means for directing signals includes an electric circuit connected to said terminals and to each of said launch mechanisms.

10. A sonobuoy system in accordance with claim 9 in which said circuit interconnecting said terminals with said launch mechanisms includes a thermally actuated switch held open in response to the presence of a signal for a predetermined time and closed in response to removal of said signal.

11. A sonobuoy system in accordance with claim 9 in which said electric circuit includes a stepping switch responsive to said signals for connecting successive signals to said launch mechanisms sequentially.

12. A sonobuoy system in accordance with claim 1 in which said container and said sonobuoys are generally cylindrical in shape.

13. A sonobuoy system in accordance with claim 12 in which said container includes first and second ends, said first end being the end through which said sonobuoys are launched, a cap fastened to said second end, said cap having a central opening, and a hollow housing fastened to said cap and closing said opening.

14. A sonobuoy system in accordance with claim 13 in which each of said sonobuoys has a forward end and an aft end, and in which said sonobuoys are installed in said container in axial alignment with said aft ends towards said cap.

15. A sonobuoy system in accordance with claim 14 in which one of said launch mechanisms is installed in said housing.

16. A sonobuoy system in accordance with claim 15 which includes a generally cylindrical forward bulkhead and a generally cylindrical aft bulkhead for each of said sonobuoys, said bulkheads being contoured to cradle their associated sonobuoy between them and to define a space between adjacent sonobuoys, each of said bulkheads having a flange engaging the interior surface of said container.

17. A sonobuoy system in accordance with claim 16 in which each of said forward bulkheads includes a plurality of aft extending fingers, each formed with a radially extending frangible tab and in which said container is formed with a plurality of recesses receiving said tabs.

18. A sonobuoy system in accordance with claim 17 in which one of said launch mechanisms is installed in each of said spaces between adjacent sonobuoys and fastened to the adjacent forward bulkheads.

* * * * *